United States Patent [19]

Propst

[11] 4,409,806

[45] Oct. 18, 1983

[54] LOCKING SYSTEM USING CODABLE MAGNETIC CARDS

[75] Inventor: Robert L. Propst, Bellevue, Wash.

[73] Assignee: Herman Miller, Inc., Zeeland, Mich.

[21] Appl. No.: 262,841

[22] Filed: May 12, 1981

[51] Int. Cl.[3] ..... E05B 47/00

[52] U.S. Cl. ..... 70/276; 70/354; 70/413

[58] Field of Search ..... 70/276, 413, 349, 353, 70/354

[56] References Cited

U.S. PATENT DOCUMENTS

| | | | |
|---|---|---|---|
| 2,384,208 | 9/1945 | Stroud | 70/276 |
| 2,557,028 | 6/1951 | Deutsch | 70/363 |
| 3,831,986 | 8/1974 | Kobayashi | 70/276 |
| 3,837,193 | 9/1974 | Csurgay | 70/276 |

*Primary Examiner*—Robert L. Wolfe

*Attorney, Agent, or Firm*—Stephenson and Boller

[57] ABSTRACT

A card operable magnetic lock apparatus comprising an elongated non-magnetic plate member and a plurality of tumbler members which are normally biased into engagement in longitudinally spaced recesses of the plate member to prevent longitudinal movement thereof. The tumbler members pivot about a common axis and have north and south magnetic poles which are substantially opposite relative to the axis. A properly encoded magnetic card can be positioned adjacent the tumbler members to urge the tumbler members out of engagement in the recesses to free the plate member for longitudinal movement.

21 Claims, 8 Drawing Figures

LOCKING SYSTEM USING CODABLE MAGNETIC CARDS

BACKGROUND OF THE INVENTION

1. Field of the Invention

The present invention relates to locking devices and, more particularly, to card operable magnetic locks of the type having magnetic locking tumblers adapted to be displaced by a coded magnetic card.

2. Description of the Prior Art

Card operable magnetic locks have been widely used for operating parking lot gates, turnstiles, doors, and other barriers in various types of access control systems. As typified by U.S. Pat. No. 3,271,983, such locks comprise a core which carries a plurality of slidable magnetic tumbler pins arranged in a predetermined pattern and biased into locking openings of one or more lock plates to prevent relative movement of the lock plates. A magnetically coded card having magnetic areas or elements arranged in a pattern corresponding to the tumbler pins is inserted into the lock so as to displace the tumbler pins axially from the openings in the lock plate to permit relative movement of the core or actuate a switch.

Such card operable magnetic locks permit the use of relatively low cost cards in place of conventional keys and provide high security due to the numerous magnetic codes that can be utilized. However, such prior art devices are relatively expensive, cannot be easily reprogrammed to new magnetic codes, and usually require electrical actuation of the barrier itself. Accordingly, card operable magnetic devices are not generally used in lock applications such as storage cabinets and storage lockers. Previous attempts to provide reprogramming features within a card operable magnetic device, as disclosed in U.S. Pat. No. 3,444,722, require the addition of movable code combination members which further increase complexity and expense. Locks having rotary magnetic tumbler elements, as disclosed in U.S. Pat. No. 3,633,393, have not been used with cards in place of conventional keys and have not been easily reprogrammable.

Accordingly, it is a general object of the present invention to provide an improved card operable magnetic lock.

It is another object of the present invention to provide a mechanism of the above type in which the magnetic code can be easily changed.

It is a further object of the present invention to provide a magnetically operated lock mechanism which can be used without electrical assistance to provide an access control for storage cabinets, lockers, doors, and similar devices.

It is a further object of the present invention to provide a magnetically operated lock mechanism of the above type which is simple in construction and economical to produce.

SUMMARY OF THE INVENTION

The present invention is a card operable magnetic lock which comprises an elongated plate member of non-magnetic material and a plurality of tumbler members which are pivotable into engaging relationship with the plate member so as to prevent movement thereof. The plate member has a plurality of longitudinally spaced recesses and is normally movable back and forth longitudinally. The tumbler members pivot about an axis which is parallel to the plate member and are spaced apart along the axis so as to be engagable, respectively, in associated recesses of the plate member. A magnetic polarity is fixed into each tumbler member so as to establish north and south magnetic poles thereon which are substantially opposite each other relative to the axis about which the tumbler members pivot.

In the operation of the magnetic lock of the present invention, a codable magnetic card is positioned proximate to the tumbler members to urge the tumbler members out of engagement in the recesses of the plate member so as to free the plate member for longitudinal movement. The magnetic card is then manually pushed against the plate member to move it longitudially so as to release a cabinet door or other barrier which is equipped with the device. The magnetic card has a plurality of magnetic areas or elements in registration with respective magnets of the tumbler members so as to pivot the tumbler members about the axis by means of magnetic attraction or repulsion between opposite or alike magnetic poles, respectively. The magnetic code of the locking device can be easily changed by simply reversing the magnetic polarity of one or more of the tumbler members.

As a result of the present invention, the advantages of a card operable magnetic lock may be realised in a form which is particularly economical to manufacture and convenient to reprogram. The tumbler members may be elongated and flat with a mounting hook about their midpoint so as to be reversible end-for-end to effect the reversed polarity required to charge the magnetic code. The locking device may be largely molded of plastic with an integral pivot bar for the axis of rotation of the tumbler members and with channels to facilitate sliding movement of the magnetic card and plate member. The magnetic card may have a credit card configuration and may include a conventional magnetizable strip which can be easily "erased" and reprogrammed for use with the locking device after the magnetic code has been changed by reversing the polarity of one or more of the tumbler members.

Further objects, features, and advantages of the present invention will become apparent from a consideration of the following description, the appended claims, and the accompanying drawings.

DESCRIPTION OF THE PREFERRED EMBODIMENT

Figure 1:
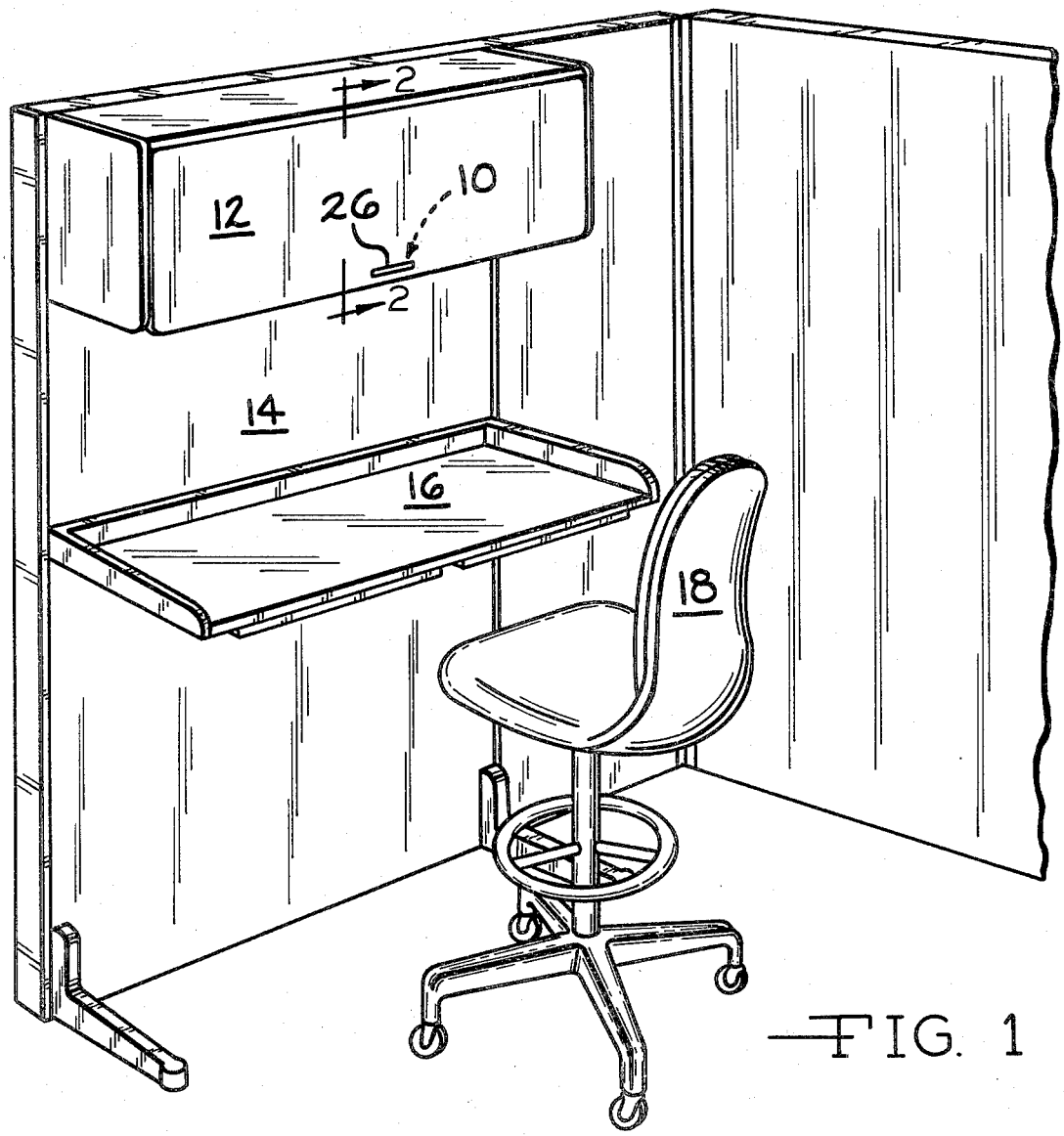
FIG. 1 is a perspective view of a storage cabinet equipped with the card operable magnetic lock of the present invention shown in relation to an office environment including a work table, room dividers, and swivel chair.

With reference to the drawing, the card operable magnetic lock of the present invention, indicated generally at 10, is illustrated in FIG. 1 as it would appear in an office environment having a typical storage cabinet 12 equipped with the device. The storage cabinet 12 is shown mounted upon a vertical wall divider 14 which also supports a work table 16. A rollable swivel chair or stool 18 faces the wall divider 14 to facilitate use of the work table 16 and allow access to the storage cabinet 12.

Figure 2:
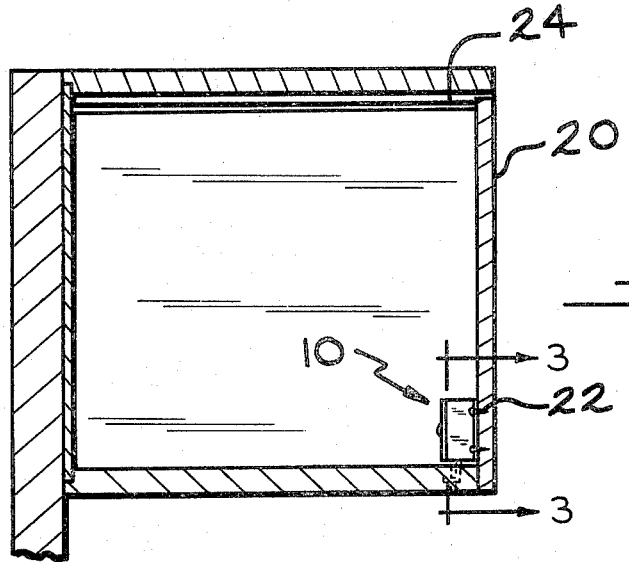
FIG. 2 is a sectional view of the storage cabinet of FIG. 1 taken along the line 2—2 of FIG. 1.

As is shown in FIG. 2, the magnetic lock 10 of the present invention is secured to the inside bottom surface of the cabinet door 20 by means of wood or sheet metal screws 22. The cabinet door 20 is supported upon pins, not shown, adjacent its upper edge which slide within tracks 24 to provide pivoting and guiding of the cabinet door 20 from its closed vertical position shown in FIG. 2 to a substantially horizontal open position inside the storage cabinet 12 adjacent the tracks 24. A narrow slot 26 is provided in the cabinet door 20 adjacent the magnetic lock 10 to provide magnetic card access to the lock mechanism.

Figure 7:
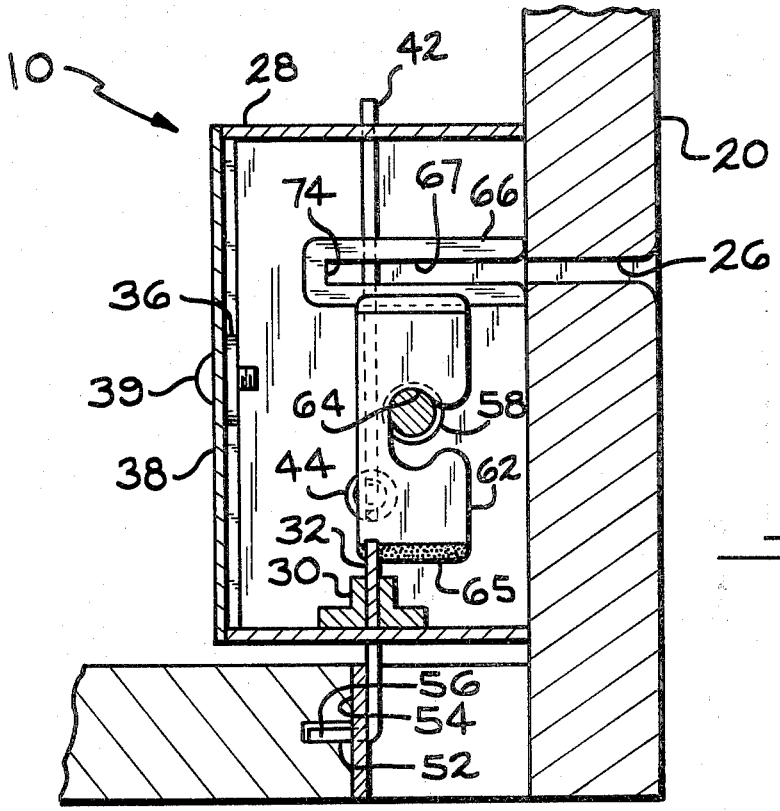
FIG. 7 is a sectional view of the locking device taken along the line 6—6 of FIG. 3.
Figure 8:
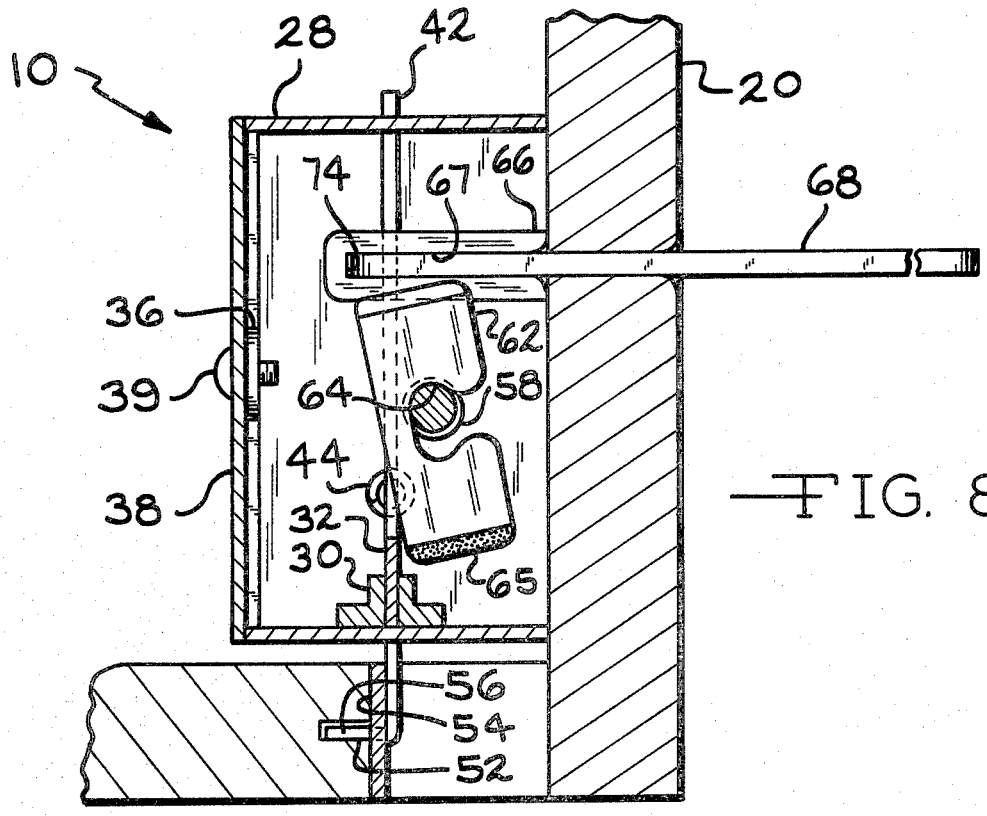
FIG. 8 is a sectional view like FIG. 7 showing pivoting of a tumbler member in response to insertion of a properly encoded magnetic card.

The magnetic lock 10 includes a generally horizontal rectangular box shaped housing 28 having internal support flanges 30 which form a channel to slidably mount an elongated non-magnetic plate member 32 for longitudinal back and forth movement within the housing. The housing 28 also includes external mounting flanges 34 at the ends thereof to facilitate attachment of the mounting screws 22. Mounting ears 36 extend from the end walls of the housing 28 to facilitate installation and removal of an inspection panel 38 by means of mounting screws 39, as shown in FIGS. 7 and 8. A longitudinally extending alignment and stop slot 40 is provided in the top wall of the housing 28 for the insertion of an alignment and stop tab 42 of the plate member 32 to maintain the plate member in position between the support flanges 30 and to limit the longitudinal movement thereof. A compression spring 44 abuts one end wall of the housing 28 and engages a spring tab 46 formed in the plate member 32 to bias the plate member to one limit of its longitudinal travel.

Figure 3:
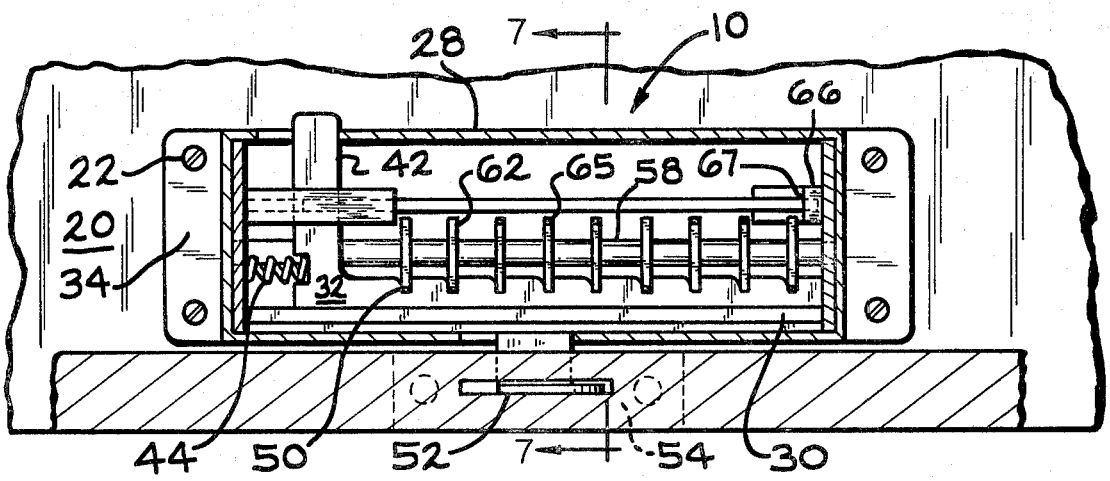
FIG. 3 is a sectional view of the locking device of the present invention taken along the line 3—3 of FIG. 2.
Figure 4:
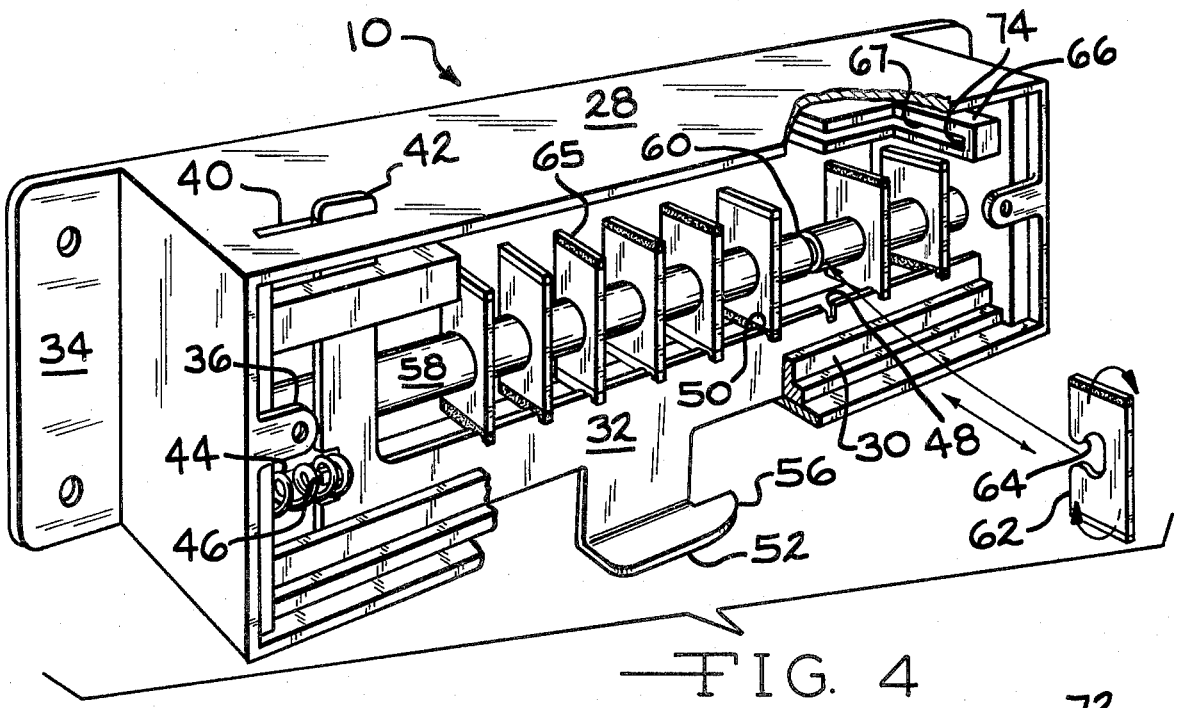
FIG. 4 is a perspective view of the locking device with the inspection panel removed and parts cut away.

The plate member 32 also includes recesses or notches 48 which are regularly spaced longitudinally along its upper edge. As shown in FIGS. 3 and 4, these recesses 48 have radiused portions 50 extending toward the end of the plate member 32 adjacent the compression spring 44 but are otherwise of square transverse configuration. The plate member 32 projects downward to form a hook 52 which is engageable with a fixed bottom portion 54 of the storage cabinet 12, as shown in FIGS. 7 and 8, to secure the cabinet door 20 in the closed position. A beveled striker tab 56 is provided on the hook 52 to slidably engage the bottom portion 54 so as to displace the plate member 32 longitudinally to facilitate closing and latching of the cabinet door 20.

The housing 28 also includes an internal pivot bar 58 which is generally cylindrical in shape and has its axis aligned parallel to and somewhat above the recesses 48 along the upper edge of the plate member 32. The pivot bar 48 has a series of annular channels 60 which are spaced longitudinally thereon so as to be in alignment with the recesses 48 of the plate member 32.

A plurality of tumbler members 62 is pivotably mounted in the annular channels 60. Each of the tumbler members 62 is of generally flat rectangular configuration with a book-shaped contour 64 formed along one side thereof to permit hanging of the tumber members 62 in the annular channels 60 so as to be transverse of the pivot bar 58. In the embodiment shown, the hook shaped contour 64 is formed symmetrically with respect to the ends of the tumbler member to permit an alternative installation of the tumbler member in a reversed end-for-end orientation. FIG. 4 shows the lagoon shaped cutout of the tumbler members 62 of the preferred embodiment which provides this reversible feature.

As shown in FIG. 7, the balance point provided by the hook shaped contour 64 is such that each of the tumbler members 62 is biased by the force of gravity into engagement in the respective recess 48 to prevent relative movement of the plate member 32. It is within the purview of this invention to accomplish the biasing of the tumbler members by a variety of means such as compression, tension torsion, or coil springs rather than solely by the specific structure that is illustrated. Applicant points out that utilization of the locking device in non-horizontal applications is possible with such alternative biasing means. Tumbler magnets 65 are mounted on the tumbler members 62 to establish north (stippled) and south magnetic poles at the opposite ends thereof.

Figure 5:
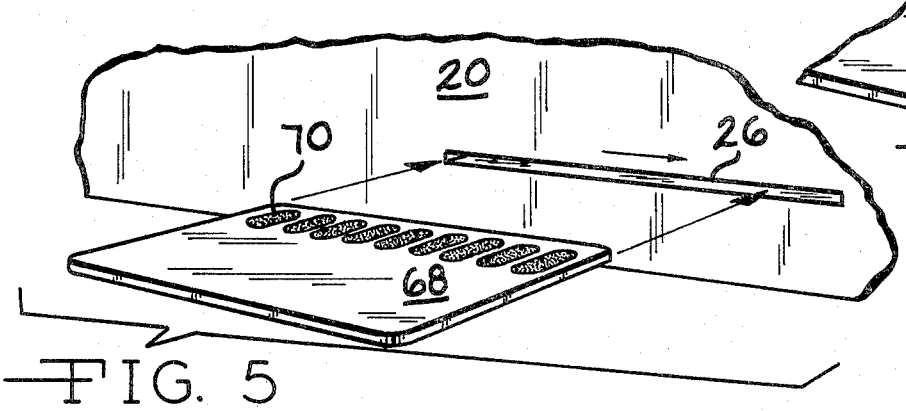
FIG. 5 is a perspective view of a magnetic card for use with the present invention in position for insertion into the door of the storage cabinet of FIG. 1.

An internal boss 66 having a central channel 67 is molded into the end wall of the housing 28 which is opposite the compression spring 44 to provide for sliding movement of a magnetic card 68 which may be inserted through the slot 26 of the cabinet door 20. The magnetic card 68 includes a plurality of discrete magnets 70 which are spaced along an edge thereof as shown in FIG. 5 so as to be positionable adjacent the upper ends of the tumbler members 62. In the embodiment shown in FIG. 6, the magnetic card 68 has a conventional credit card configuration and includes a magnetizable strip 72 which is embedded within or cemented upon a suitable plastic base material along one edge of the card. By the use of well-known and commercially available encoding devices, the magnetizable strip can be easily erased and reprogrammed to provide the desired polarity equivalent to that of the discrete magnets 70. The construction of the magnetic card 68 is of sufficient stiffness and durability ot permit its use as an abutment means to manually actuate the plate member 32.

Figure 6:
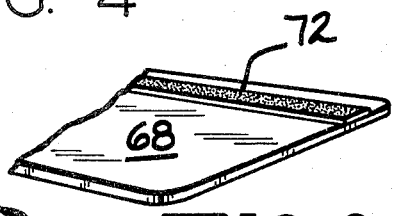
FIG. 6 is a partial perspective view of a magnetic card like that of FIG. 5 but having a magnetizable strip in place of discrete magnetic elements.

The operation of the locking system of the present invention is as follows: When the cabinet door 20 is in the closed and locked position, each of the pivotable tumbler members 62 is biased by the force of gravity into engagement in the recesses 48 of the plate member 32 as shown in FIG. 6. The hook 52 of the plate member 32 engages the bottom portion 54 of the storage cabinet 12 to prevent opening of the cabinet door 20. The position of the hook 52 is maintained in engaging relationship with the bottom portion 54 by the engagement of the tumbler members 62 in the recesses 48. The recesses 48 are radiused only along the portions 50 as previously described so as to facilitate the free pivoting of the tumbler members 62 without interfering with the locking of the plate member.

Upon insertion of the magnetic card 68 having the proper polarity of the discrete magnets 70 or magnetizable strip 72, as shown in FIG. 7, the upper end of each tumbler member 62 is urged laterally and downward. These forces result from magnetic repulsion between alike magnetic poles of the tumbler magnets 70 at the upper end of the tumbler members 62 and of the adjacent magnets 70 or 72. Due to the pivotal mounting of the tumbler members 62 upon the pivot bar 58, the magnetic repulsion results in a pivoting of each tumbler member 62 about the pivot bar 58 such that the lower end of each tumbler member is pivoted out of engagement in the associated recess 48. Alternatively, magnetic attraction between opposite magnetic poles could be utilized to urge the tumbler members out of engagement with the plate member.

The initial insertion of the magnetic card 68 is transverse with respect to the plate member 32 and the pivot bar 58. This movement is guided by the channel 67 and the narrow slot 26 of the cabinet door 20. The location of the magnetic card 68 is further defined by the stop surface 74 terminating the channel 67 and by the alignment tab 42 of the plate member 32 which provides a longitudinal stop. After each of the tumbler members 62 has pivoted clear of the recesses 48, the magnetic card 68 is moved longitudinally with respect to the plate member 32 against the alignment tab 42 to push the plate member 32 longitudinally to a position in which the hook 52 is no longer in engaging relationship to the bottom portion 54 of the storage cabinet. This longitudinal movement of the plate member 32 is guided by the support flanges 30 and is stopped by the engagement of the alignment tab 42 with the end of the alignment slot 40 which is nearest the compression spring 44.

When the magnetic card 68 is removed, the compression spring 44, which was compressed by the longitudinal displacement of the plate member 32, returns the plate 32 to its normal position in which the alignment tab 42 is stopped by the end of the alignment slot 40 which is opposite the compression spring. After the cabinet door 20 is returned to the closed position, the tumbler members 62 are again pivoted about the pivot bar 58 by the force of gravity so as to engage the recesses 48 and lock the hook 52 of the plate member 32 in engaging position with respect to the bottom portion 54 of the storage cabinet 12. The striker tab 56 facilitates latching of the cabinet door 20 by slidably engaging the bottom portion 54 to momentarily compress the compression spring 44.

Whenever a different magnetic code is desired, an operator of the locking device merely opens the cabinet door 20 using the old magnetic code, removes the inspection panel 38 which is secured by means of the mounting ears 36 and the mounting screws 39, and manually removes and inverts one or more of the tumbler members 62 as indicated by the arrows in FIG. 4. The magnetic card 68 is then reprogrammed to the new magnetic code by means of a conventional magnetic encoding device.

It will be seen from the foregoing description of the preferred embodiment that the present invention provides an improved card operable magnetic lock which is simple in construction, economical to produce, and conveniently reprogrammed to new magnetic codes. The magnetic lock of the present invention provides a mechanically operable access control for storage cabinets, lockers, doors, and similar devices without the need for electrical actuation of a latch. While the preferred embodiment has been described in considerable detail, the present invention is not to be limited to such detail, except as may be necessitated by the appended claims.

What is claimed is:

1. A magnetic lock apparatus adapted to be operated by a properly encoded magnetic card, said apparatus comprising:

a longitudinally movable elongated plate member made of non-magnetic material and having means forming a plurality of longitudinally spaced recesses thereon and a plurality of tumbler members spaced apart and pivotable about a common axis which is substantially parallel to said plate member, each said tumbler member being biased into engagement, respectively, in an associated one of said recesses to prevent relative movement of said plate member, and each said tumbler member being magnetically fixed so as to establish north and south magnetic poles thereon, said magnetic poles being operable to pivot said tumbler members out of engagement in said recesses when said magnetic card is placed adjacent said tumbler members.

2. A magnetic lock apparatus as recited in claim 1 wherein said tumbler members are elongated and are pivotally mounted intermediate the ends thereof, said tumbler members being removable from said common axis and reversible end-for-end so as to be mountable about said common axis with said north and south magnetic poles reversed.

3. A magnetic lock system adapted for use in combination with a storage cabinet, said system comprising:

a housing;

an elongated plate member slidably mounted for longitudinal movement within said housing and having means forming a plurality of longitudinally spaced recesses in said plate member, said plate member being movable between a locked position in which opening of said cabinet is prevented and an unlocked position enabling opening of said cabinet;

a plurality of tumbler members longitudinally spaced apart and pivotally mounted within said housing about a common axis which is substantially parallel to said plate member, said tumbler members being biased into engagement, respectively, in associated ones of said recesses to prevent movement of said plate member;

magnetic means on each said tumbler member establishing north and south magnetic poles thereon substantially opposite each other relative to said axis; and a magnetic card positionable within said housing adjacent said tumbler members and having a plurality of magnetic elements in registration with said tumbler members so as to pivot said tumbler members out of engagement in said recesses by magnetic repulsion.

4. A magnetic lock system as recited in claim 3 wherein said plate member is movable from said locked position to said unlocked position by the abutment of an extension of said plate member by said magnetic card, said magnetic card being guidably movable longitudinally from a first position adjacent said extension in which said magnetic elements are in registration with said tumbler members to a second position adjacent said extension corresponding to said unlocked position of the plate member.

5. A magnetic lock system as recited in claim 4 wherein said housing includes a channel extending transversely with respect to said plate member for guiding said magnetic card transversely vis-a-vis said plate member to said position in which said magnetic elements are in registration with said tumbler members.

6. A magnetic lock system as recited in claim 3 wherein said common axis of said tumbler member is located above said recesses, said tumbler members being biased into engagement in said associated recesses by gravitational force acting upon said tumbler members and urging pivoting thereof.

7. A magnetic lock system as recited in claim 3 wherein said tumbler members are elongated and are pivotally mounted intermediate the ends thereof, said tumbler members being removable from said common axis and reversible end-for-end so as to be mountable about said common axis with said north and south magnetic poles reversed.

8. A magnetic lock system as recited in claim 7 which further comprises a pivot bar mounted on said housing in alignment with said common axis and wherein said tumbler members are of generally flat rectangular configuration and have means forming an opening midway between the ends thereof, said tumbler members being mountable upon said pivot bar by engagement of said pivot bar by said opening.

9. A magnetic lock system as recited in claim 3 wherein said magnetic means includes a magnetizable strip, said magnetizable strip being encoded so as to comprise said north and south magnetic poles.

10. A reversible tumbler for a magnetic lock having a pivot bar, said tumbler comprising:

a non-magnetic reversible tumbler body and means forming magnetic poles of opposite polarity upon said body, said body having a pair of alternate off-center fulcrum portions, one for each magnetic pole, each spaced equally from its respective magnetic pole, whereby said tumbler body may be swung toward and away from a locking position by means of whichever of said fulcrum portions is selected to operate on the pivot bar of the lock.

11. A reversible tumbler as recited in claim 10 wherein each of said fulcrum portions includes means forming a respective hook open to one edge of said tumbler for access.

12. A reversible tumbler as recited in claim 10 wherein said tumbler body has an elongated slot therein and wherein said fulcrum portions are at opposite ends of said slot.

13. A reversible tumbler as recited in claim 12 wherein said slot is open intermediate its ends to an edge of said tumbler body so as to form a pair of opposed hooks comprising said fulcrum portions with an access opening there-between for passage of a pivot bar.

14. In a magnetic lock having a changeable code, a pivot bar and a plurality of reversible tumblers, each comprising a reversible tumbler body having a pair of magnetic poles spaced thereon and having a pair of alternate off-center fulcrum portions, one for each magnetic pole, each of said tumblers being gravity biased to swing into a locking position when operating by either of said fulcrum portions upon said pivot bar so as to permit said tumblers to be arranged with said magnetic poles in a variety of codes determined by which fulcrum portions are actively positioned to operate on the pivot bar.

15. In a magnetic lock as recited in claim 14, said pivot bar having spaced circumferential grooves formed therein for receiving said actively positioned fulcrum portions.

16. In a magnetic lock, a pivot bar having a circumferential groove, a reversible tumbler having an elongated slot of a width so as to interfit said groove to prevent movement of said tumbler along the pivot bar while leaving said tumbler free to swing on the bar at either end of the slot, and having a pair of magnetic poles of opposite polarity spaced equally from respective ends of said slot.

17. In a magnetic lock as recited in claim 16, said tumbler having said slot open intermediate the ends of the slot to an edge of the tumbler so as to provide a lateral access opening for the pivot bar at the location of said groove.

18. A magnetic lock system comprising, a housing having an entryway therein, keeper means mounted within the housing movable between locked and unlocked positions, tumbler means including a plurality of tumbler members swing-mounted within the housing and biased to engage said keeper means when the keeper means is in said locked position so as to prevent the keeper means from being moved into said unlocked position, a pivot bar adjacent said keeper means, each of said tumbler members being loosely pivotally mounted on said pivot bar for ready removal therefrom and reversal thereon, said tumbler members having respective magnetic poles located in proximity to said entryway, the polarities of said poles being in accordance with a polarity code, and a key card adapted to be inserted in said entryway so as to present magnetic poles polarized in accordance with said code and arranged to interact with respective poles of the tumbler members so as to cause all of said tumbler members to swing counter to said bias and disengage from said keeper means such that the keeper means can be moved to said unlocked position when the key card occupies the entryway.

19. A magnetic lock system as recited in claim 18 wherein said tumbler members are gravity biased.

20. A magnetic lock system as recited in claim 18 wherein said tumblers each have a swing axis parallel to and spaced from the plane of said key card when the key card occupies the entryway.

21. A magnetic lock system as recited in claim 18 in which part of said keeper means is arranged so as to be engaged and moved by manipulation of said key card into said unlocked position when the key card occupies said entryway.

* * * * *